US012384982B2

(12) United States Patent
Fujita et al.

(10) Patent No.: US 12,384,982 B2
(45) Date of Patent: Aug. 12, 2025

(54) LUBRICATING OIL COMPOSITION

(71) Applicant: IDEMITSU KOSAN CO., LTD., Chiyoda-ku (JP)

(72) Inventors: Shoichiro Fujita, Chiba (JP); Kenji Sunahara, Tsukuba (JP); Tsukasa Yamagishi, Chiba (JP); Masaya Kubota, Ichikawa (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/260,064

(22) PCT Filed: Mar. 4, 2022

(86) PCT No.: PCT/JP2022/009270
§ 371 (c)(1),
(2) Date: Jun. 30, 2023

(87) PCT Pub. No.: WO2022/209569
PCT Pub. Date: Oct. 6, 2022

(65) Prior Publication Data

US 2024/0101924 A1 Mar. 28, 2024

(30) Foreign Application Priority Data

Mar. 30, 2021 (JP) ..... 2021-058415

(51) Int. Cl.

| | |
|---|---|
| ***C10M 161/00*** | (2006.01) |
| ***C10M 157/04*** | (2006.01) |
| ***C10N 10/12*** | (2006.01) |
| ***C10N 20/04*** | (2006.01) |
| ***C10N 30/02*** | (2006.01) |
| ***C10N 30/04*** | (2006.01) |
| ***C10N 30/06*** | (2006.01) |
| ***C10N 40/25*** | (2006.01) |

(52) U.S. Cl.
CPC ..... *C10M 161/00* (2013.01); *C10M 157/04* (2013.01); *C10M 2209/084* (2013.01); *C10M 2217/06* (2013.01); *C10M 2219/068* (2013.01); *C10M 2223/045* (2013.01); *C10M 2225/00* (2013.01); *C10N 2010/12* (2013.01); *C10N 2020/04* (2013.01); *C10N 2030/02* (2013.01); *C10N 2030/04* (2013.01); *C10N 2030/06* (2013.01); *C10N 2040/252* (2020.05)

(58) Field of Classification Search
CPC ..... C10M 157/04; C10M 161/00; C10M 2209/084; C10M 2217/06; C10M 2219/068; C10M 2223/045; C10M 2225/00; C10N 2010/12; C10N 2020/04; C10N 2030/02; C10N 2030/04; C10N 2030/06; C10N 2040/252
See application file for complete search history.

(56) References Cited

U.S. PATENT DOCUMENTS

| | | | | |
|---|---|---|---|---|
| 4,281,081 | A | 7/1981 | Jost et al. | |
| 4,282,132 | A | 8/1981 | Benda et al. | |
| 5,523,008 | A * | 6/1996 | Boden | C10M 157/04 525/283 |
| 2002/0032293 | A1 | 3/2002 | Bryant et al. | |
| 2006/0189492 | A1 | 8/2006 | Bera et al. | |
| 2015/0075061 | A1 | 3/2015 | Patel et al. | |
| 2015/0119303 | A1* | 4/2015 | Guerin | C10M 161/00 508/304 |
| 2016/0108336 | A1* | 4/2016 | Oh | C10M 161/00 508/365 |
| 2017/0283732 | A1 | 10/2017 | Sauer et al. | |
| 2019/0119602 | A1* | 4/2019 | Ransom | C10M 169/048 |
| 2019/0270947 | A1 | 9/2019 | Hogendoorn et al. | |

FOREIGN PATENT DOCUMENTS

| | | | |
|---|---|---|---|
| CN | 101058761 | A | 10/2007 |
| CN | 106164231 | A | 11/2016 |
| CN | 107075405 | A | 8/2017 |
| CN | 107532106 | A | 1/2018 |
| JP | 46-15786 | | 4/1971 |
| JP | 54-117592 | A | 9/1979 |
| JP | 55-25492 | A | 2/1980 |
| JP | 9-3131 | A | 1/1997 |
| JP | 2006-16453 | | 1/2006 |
| JP | 2006-225663 | A | 8/2006 |

(Continued)

OTHER PUBLICATIONS

International Search Report and Written Opinion issued May 17, 2022, in PCT/JP2022/009270 (with English Translation), 17 pages.
Japanese Notice of Reasons for Refusal issued Jul. 16, 2024 in Japanese Application No. 2021-058415 with English translation, 5 pgs.
Office Action issued Dec. 20, 2024, in corresponding European Patent Application No. 22779794.1, 8 pages.
Chinese Office Action and Search Report issued Jun. 11, 2025 in corresponding Chinese Patent Application No. 202280025478.2, with English Translation, 23 pages, citing documents 15-20 therein.

*Primary Examiner* — James C Goloboy

(74) *Attorney, Agent, or Firm* — Oblon, McClelland, Maier & Neustadt, L.L.P.

(57) ABSTRACT

A lubricating oil composition may contain a base oil (A) and a dispersant-type viscosity index improver (B), in which the nitrogen atom content based on the solid content of the dispersant-type viscosity index improver (B) is 0.50 to 1.50% by mass, and the weight-average molecular weight (Mw) thereof is 100,000 or more, and the content in terms of the solid content based on the total amount of the composition of the dispersant-type viscosity index improver (B) is more than 0.05% by mass and less than 5.0% by mass. The lubricating oil composition may exert excellent wear resistance in a state contaminated with soot.

20 Claims, No Drawings

(56) References Cited

FOREIGN PATENT DOCUMENTS

| | | | |
|---|---|---|---|
| JP | 2014-125569 | A | 7/2014 |
| JP | 2016-534213 | A | 11/2016 |
| JP | 2018-111779 | | 7/2018 |
| JP | 2019-77864 | A | 5/2019 |
| WO | WO 2020/187954 | A1 | 9/2020 |

* cited by examiner

LUBRICATING OIL COMPOSITION

CROSS-REFERENCE TO RELATED APPLICATIONS

The present application is the national stage of international application PCT/JP2022/009270, filed on Mar. 4, 2022, and claims the benefit of the filing date of Japanese Appl. No. 2021-058415, filed on Mar. 30, 2021.

TECHNICAL FIELD

The present invention relates to a lubricating oil composition.

BACKGROUND ART

Heretofore, there has been known a problem of a lubricating oil for use in internal combustion engines such as gasoline engines and diesel engines in that soot is generated with degradation of the lubricating oil, and for dispersing the soot in oil, a dispersant is often blended therein.

In some lubricating oil compositions, a viscosity index improver is blended for the purpose of improving the viscosity index of the compositions, and a dispersant-type viscosity index improver given a dispersion performance by the use of a polar group-having comonomer is known.

Regarding such a dispersant-type viscosity index improver, there are known ones having a nitrogen atom in the molecule, and for example, PTL 1 disclose a reaction product of an olefin copolymer, an acylating agent and a polyamine, and PTL 2 discloses a dispersant-type polyalkyl (meth)acrylate produced by copolymerizing an N-dispersant-type monomer.

CITATION LIST

Patent Literature

PTL 1: JP2019-77864A
PTL 2: JP2016-534213A

SUMMARY OF INVENTION

Technical Problem

However, as a result of investigations made by the present inventors, it has been proven that, when a lubricating oil contaminated with soot is used, wear resistance is not always good.

The present invention has been made in consideration of the above-mentioned problems, and its object is to provide a lubricating oil composition still excellent in wear resistance even in a condition contaminated with soot.

Solution to Problem

As a result of assiduous studies made by the present inventors, it has been found that a lubricating oil composition containing, as blended therein, a specific dispersant-type viscosity index improver can solve the above-mentioned problems, and the present invention has been thus completed.

Specifically, the present invention provides the following [1] to [4].

[1] A lubricating oil composition containing a base oil (A) and a dispersant-type viscosity index improver (B), in which the nitrogen atom content based on the solid content of the dispersant-type viscosity index improver (B) is 0.50 to 1.50% by mass, and the weight-average molecular weight (Mw) thereof is 100,000 or more, and the content in terms of the solid content based on the total amount of the composition of the dispersant-type viscosity index improver (B) is more than 0.05% by mass and less than 5.0% by mass.

[2] A method for producing the lubricating oil composition of [1], including a step of mixing the base oil (A) and the dispersant-type viscosity index improver (B).

[3] A diesel engine containing the lubricating oil composition of [1].

[4] A method for lubricating an engine using the lubricating oil composition of [1].

Advantageous Effects of Invention

According to the present invention, there can be provided a lubricating oil composition excellent in wear resistance even in a condition contaminated with soot.

DESCRIPTION OF EMBODIMENTS

The upper limit and the lower limit of a numerical range described in the present description can be combined in any arbitrary manner. For example, in the case where numerical ranges of "A to B" and "C to D" are described, numerical ranges of "A to D" and "C to B" are also included in the scope of the present invention.

"An upper limit to a lower limit of a numerical range described in the present description means, unless otherwise specifically indicated, a lower limit or more and an upper limit or less.

Also in the present description, the numerical values in Examples are numerical values that can be used as an upper limit or a lower limit.

Also in the present description, for example, "(meth) acrylate" is used as a term indicating both "acrylate" and "methacrylate", and the same shall apply to other similar terms and similar expressions.

[Lubricating Oil Composition]

The lubricating oil composition of the present embodiment is a lubricating oil composition containing a base oil (A) and a dispersant-type viscosity index improver (B), in which the nitrogen atom content of the dispersant-type viscosity index improver is 0.50 to 1.50% by mass, the weight-average molecular weight (Mw) thereof is 100,000 or more, and the content in terms of the solid content based on the total amount of the composition of the dispersant-type viscosity index improver (B) is more than 0.05% by mass and less than 5.0% by mass.

As a result of assiduous studies made by the present inventors for solving the above-mentioned problems, it has been known that the soot dispersed by a dispersant wears the lubricant coating film formed on the surface of a metal member to worsen wear resistance.

Further, it has been found that, even in the case of using a dispersant-type viscosity index improver, the wear resistance could not always be improved depending on the kind thereof, and that, by blending a predetermined amount of a dispersant-type viscosity index improver having a specific nitrogen atom content and a specific weight-average molecular weight, the wear resistance between metal members in an environment that may be contaminated with soot can be improved, and the present invention is thus completed.

Hereinunder the constituent components contained in the lubricating oil composition of the present embodiment are described.

<Base Oil (A)>

The lubricating oil composition of the present embodiment contains a base oil (A). As the base oil (A), at least one selected from mineral oils and synthetic oils heretofore used as a base oil of a lubricating oil can be used with no specific limitation.

Examples of the mineral oil include atmospheric residues obtained through atmospheric distillation of crude oils such as paraffin-based crude oils, intermediate-based crude oils and naphthene-based crude oils; lubricating oil distillates obtained through reduced-pressure distillation of such atmospheric residues; and mineral oils or the like obtained by purifying the lubricating oil distillates through one or more purification treatments such as solvent deasphalting, solvent extraction, hydrofinishing, hydrocracking, advanced hydrocracking, solvent dewaxing, catalytic dewaxing, or hydrogenation isomerization deasphalting.

Examples of the synthetic oil include poly-α-olefins such as α-olefin homopolymers, and α-olefin copolymers (e.g., α-olefin copolymers having 8 to 14 carbon atoms such as ethylene-α-olefin copolymers); isoparaffins; various esters such as polyol esters and dibasic acid esters; various ethers such as polyphenyl ethers; polyalkylene glycols; alkylbenzenes; alkylnaphthalenes; and GTL base oils or the like obtained by isomerizing a wax produced from natural gas through a process such as Fischer-Tropsch synthesis (GTL wax, gas-to-liquid wax).

The base oil (A) for use in the present embodiment is preferably a base oil grouped in Group II or III in the base oil category of API (American Petroleum Institute), more preferably a base oil grouped in Group III.

The base oil (A) can be one alone selected from the mineral oils, or can be two or more as combined. It can also be one alone selected from the synthetic oils, or can be two or more as combined. Further, it can also be a combination of one or more mineral oils and one or more synthetic oils.

Regarding the kinematic viscosity and the viscosity index of the base oil (A), the upper limit is, from the viewpoint of bettering fuel-saving performance, and the lower limit is, from the viewpoint of reducing loss of the lubricating oil composition by evaporation to secure oil film retentiveness, preferably falls within the following ranges.

The 100° C. kinematic viscosity of the base oil (A) is preferably 2.0 $mm^2/s$ or more, and is preferably 20.0 $mm^2/s$ or less, more preferably 10.0 $mm^2/s$ or less, even more preferably 8.0 $mm^2/s$ or less, further more preferably 7.0 $mm^2/s$ or less. The upper limit and the lower limit of these numerical ranges can be combined arbitrarily and specifically preferred is 2.0 $mm^2/s$ to 20.0 $mm^2/s$, more preferred is 2.0 $mm^2/s$ to 10.0 $mm^2/s$, even more preferred is 2.0 $mm^2/s$ to 8.0 $mm^2/s$, further more preferred is 2.0 $mm^2/s$ to 7.0 $mm^2/s$.

The viscosity index of the base oil (A) is preferably 80 or more, more preferably 90 or more, even more preferably 100 or more, further more preferably 105 or more, and further more preferably 120 or more.

The 40° C. kinematic viscosity, the 100° C. kinematic viscosity and the viscosity index can be measured or calculated according to JIS K 2283:2000.

In the case where the base oil (A) is a mixed base oil containing two or more kinds of base oils, the kinematic viscosity and the viscosity index of the mixed base oil preferably fall with the above-mentioned range.

In the lubricating oil composition of the present embodiment, the content of the base oil (A) is, though not specifically limited but from the viewpoint of more readily exerting the advantageous effects of the present invention, preferably 60% by mass to 99% by mass based on the total amount (100% by mass) of the lubricating oil composition, more preferably 70% by mass to 95% by mass, even more preferably 80% by mass to 93% by mass.

<Dispersant-Type Viscosity Index Improver (B)>

The dispersant-type viscosity index improver (B) for use in the lubricating oil composition of the present embodiment needs to be such that the nitrogen atom content based on the solid content of the dispersant-type viscosity index improver (B) is 0.50 to 1.50% by mass. When the nitrogen atom content of the dispersant-type viscosity index improver (B) is less than 0.50% by mass or is more than 1.50% by mass, the wear resistance improving effect could not be exerted.

The nitrogen atom content of the dispersant-type viscosity index improver (B) is preferably 0.55% by mass or more, more preferably 0.60% by mass or more, even more preferably 0.65% by mass or more, and is preferably 1.45% by mass or less, more preferably 1.40% by mass or less, even more preferably 1.30% by mass or less. The upper limit and the lower limit of these numerical ranges can be combined in any arbitrary manner, and specifically preferred is 0.55 to 1.45% by mass, more preferred is 0.60 to 1.40% by mass, even more preferred is 0.65 to 1.30% by mass.

The dispersant-type viscosity index improver (B) needs to have a weight-average molecular weight (Mw) of 100,000 or more. When the weight-average molecular weight (Mw) of the dispersant-type viscosity index improver (B) is less than 100,000, soot may penetrate into a lubricated surface to wear the coating film on the lubricated surface, and if so, the wear resistance-improving effect in the present embodiment could not be exerted. The weight-average molecular weight (Mw) of the dispersant-type viscosity index improver (B) is, from the viewpoint of improving wear resistance, preferably 400,000 or less, more preferably 300,000 or less, even more preferably 250,000 or less.

Further, the molecular weight distribution (Mw/Mn) of the dispersant-type viscosity index improver (B) is, from the viewpoint of improving the wear resistance of a lubricated surface, preferably 3.0 or less, more preferably 2.8 or less, even more preferably 2.6 or less.

In the present description, the weight-average molecular weight (Mw) and the number-average molecular weight (Mn) of the constituent components are standard polystyrene-equivalent values measured in gel permeation chromatography (GPC).

As the dispersant-type viscosity index improver (B), preferably used are a nitrogen-containing poly(meth)acrylate and a nitrogen-containing polyolefin.

(Nitrogen-Containing Poly(Meth)Acrylate)

Specific examples of the nitrogen-containing poly(meth) acrylate include a methacrylate copolymer obtained by copolymerization of a (meth)acrylate not containing a nitrogen atom and a nitrogen atom-containing comonomer, and a hydrogenate thereof.

Specific examples of the nitrogen atom-containing comonomer include a nitrogen atom-containing vinyl compound and a nitrogen atom-containing (meth)acrylate. The nitrogen atom-containing vinyl compound includes a lactam containing a vinyl group, and is specifically N-vinyl-2-pyrrolidone. The nitrogen atom-containing (meth)acrylate includes an aminoalkyl (meth)acrylate, and specific examples of the aminoalkyl (meth)acrylate include ethylaminoethyl (meth)acrylate.

(Nitrogen-Containing Polyolefin)

The nitrogen-containing polyolefin includes a nitrogen-containing olefin-based copolymer that is a reaction product of an olefin copolymer, an acylating agent and a polyamine, and a hydrogenate thereof.

The olefin copolymer is preferably a copolymer of ethylene and an α-olefin having 3 to 28 carbon atoms, especially preferably an ethylene-propylene copolymer.

Specific examples of the olefin include ethylene, propylene, 1-butene, 2-butene, isobutene, 3-methyl-1-butene, 4-phenyl-1-butene, 1-pentene, 3-methyl-1-pentene, 4-methyl-1-pentene, 3,3-dimethyl-1-pentene, 3,4-dimethyl-1-pentene, 4,4-dimethyl-1-pentene, 1-hexene, 4-methyl-1-hexene, 5-methyl-1-hexene, 6-phenyl-1-hexene, 1-octene, 1-decene, 1-dodecene, 1-tetradecene, 1-pentadecene, 1-hexadecene, 1-heptadecene, 1-octadecene, 1-nonadecene, and 1-eicosene.

As the acylating agent, preferably employed are an unsaturated carboxylic acid and an anhydride thereof.

The unsaturated carboxylic acid includes acrylic acid, methacrylic acid, cinnamic acid, crotonic acid, maleic acid, fumaric acid and itaconic acid.

The anhydride of the unsaturated carboxylic acid include maleic anhydride.

As the polyamine, preferably employed are an aromatic diamine and an aromatic triamine. More specifically preferred is an N-arylphenylenediamine, even more specifically preferred is N-phenylphenylenediamine.

The content of the dispersant-type viscosity index improver (B) for use in the lubricating oil composition of the present embodiment needs to be, in terms of the solid content based on the total amount of the composition, more than 0.05% by mass and less than 5.0% by mass. When the content of the dispersant-type viscosity index improver is less than 0.05% by mass, the wear resistance improving effect could not be exerted, and when the content is more than 5.0% by mass, viscosity characteristics worsen.

The content of the dispersant-type viscosity index improver (B) is, in terms of the solid content based on the total amount of the composition, preferably 0.06% by mass or more, more preferably 0.08% by mass or more, even more preferably 0.10% by mass or more, and is preferably 2.0% by mass or less, more preferably 1.0% by mass or less, even more preferably 0.50% by mass or less. The upper limit and the lower limit of the numerical range can be combined in any arbitrary manner. Specifically, preferred is 0.06 to 2.0% by mass, more preferred is 0.08 to 1.0% by mass, even more preferred is 0.10 to 0.50% by mass.

<Non-Dispersant-Type Viscosity Index Improver (C)>

The lubricating oil composition of the present embodiment can further contain a non-dispersant-type viscosity index improver (C) not containing a nitrogen atom.

Examples of the non-dispersant-type viscosity index improver (C) include polymers such as a non-dispersant-type poly(meth)acrylate, a star-shaped polymer, an olefin-based copolymer (e.g., ethylene-propylene copolymer), and a styrene-based copolymer (e.g., styrene-diene copolymer, styrene-isoprene copolymer). Among these, a non-dispersant-type poly(meth)acrylate is preferred.

One alone or two or more kinds of these can be used either singly or as combined.

The weight-average molecular weight (Mw) of the non-dispersant-type viscosity index improver (C) is, from the viewpoint of suppressing the viscosity of the lubricating oil composition to low levels, preferably 200,000 or more, more preferably 250,000 or more, even more preferably 280,000 or more.

The blending amount of the non-dispersant-type viscosity index improver (C) is, in terms of the solid content based on the total amount of the lubricating oil composition, preferably 0.2% by mass or more, more preferably 0.5% by mass or more, even more preferably 1.0% by mass or more, and is preferably 10.0% by mass or less, more preferably 7.0% by mass or less, even more preferably 5.0% by mass or less. The upper limit and the lower limit of these numerical ranges can be combined in any arbitrary manner. Specifically preferred is 0.2 to 10.0% by mass, more preferred is 0.5 to 7.0% by mass, even more preferred is 1.0 to 5.0 by mass.

In the lubricating oil composition of the present embodiment, the ratio of the content of the non-dispersant-type viscosity index improver (C) to the content of the dispersant-type viscosity index improver (B), [(C)/(B)] is, as a ratio by mass of the solid content, preferably 0.50 or more, more preferably 1.5 or more, even more preferably 3.0 or more, and is preferably 30.0 or less, more preferably 20.0 or less, even more preferably 15.0 or less. The upper limit and the lower limit of these numerical ranges can be combined in any arbitrary manner. Specifically preferred is 0.50 to 30.0, more preferred is 1.5 to 20.0, even more preferred is 3.0 to 15.0.

Especially preferred is a combination of a dispersant-type viscosity index improver (B) having a weight-average molecular weight (Mw) of 100,000 to 250,000 and a non-dispersant-type viscosity index improver (C) having a weight-average molecular weight (Mw) of 280,000 or more combined in such a manner that the ratio of the content of the non-dispersant-type viscosity index improver (C) to the content of the dispersant-type viscosity index improver (B), [(C)/(B)] is, as a ratio by mass of the solid content, 3.0 to 15.0, since in the combination, the dispersant-type viscosity index improver (B) having a middle-degree molecular weight can express excellent wear resistance and the non-dispersant-type viscosity index improver (C) having a relatively large molecular weight can realize a low viscosity and a high viscosity index.

<Molybdenum-Based Friction Modifier (D)>

The lubricating oil composition of the present embodiment can further contain a molybdenum-based friction modifier (D). Containing a molybdenum-based friction modifier (D), the lubricating oil composition can further better the friction reducing effect. Especially in an environment in which the temperature of the lubricating oil composition is high, the composition can effectively exert the friction reducing effect.

The molybdenum-based friction modifier (D) can be any compound having a molybdenum atom, and examples thereof include molybdenum dithiocarbamate (MoDTC), molybdenum dithiophosphate (MoDTP) and amine salts of molybdic acid. Among these, from the viewpoint of lowering an intermetallic frictional coefficient to attain excellent fuel-saving performance, preferred are molybdenum dithiocarbamate (MoDTC), and molybdenum dithiophosphate (MoDTP), and more preferred is molybdenum dithiocarbamate (MoDTC).

Examples of molybdenum dithiocarbamate (MoDTC) include a binuclear molybdenum dithiocarbamate containing two molybdenum atoms in one molecule, and a trinuclear molybdenum dithiocarbamate containing three molybdenum atoms in one molecule.

Examples of the binuclear molybdenum dithiocarbamate include a compound represented by the following general formula (D-1), and a compound represented by the following general formula (D-2).

(D-1)

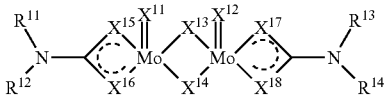

(D-2)

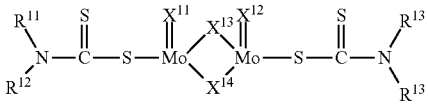

In the above general formulae (D-1) and (D-2), $R^{11}$ to $R^{14}$ each independently represent a hydrocarbon group, and these can be the same as or different from each other.

$X^{11}$ to $X^{18}$ each independently represent an oxygen atom or a sulfur atom, and can be the same as or different from each other. However, in the general formula (D-1), at least two of $X^{11}$ to $X^{18}$ are sulfur atoms.

The carbon number of the hydrocarbon group that can be selected as $R^{11}$ to $R^{14}$ is preferably 6 to 22.

Examples of the hydrocarbon group that can be selected as $R^{11}$ to $R^{14}$ in the above general formulae (D-1) and (D-2) include an alkyl group, an alkenyl group, a cycloalkyl group, an aryl group, an alkylaryl group and an arylalkyl group.

Examples of the alkyl group include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include a hexenyl group, a heptenyl group, an octenyl group, a nonenyl group, a decenyl group, an undecenyl group, a dodecenyl group, a tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group and a dimethylnaphthyl group.

Examples of the arylalkyl group include a methylbenzyl group, a phenylmethyl group, a phenylethyl group, and a diphenylmethyl group.

Among these, preferred is a molybdenum dialkyldithiocarbamate represented by the following structural formula (D-3) (hereinafter also referred to as "compound (D3)").

(D-3)

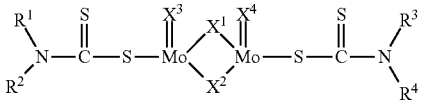

In the above general formula (D-3), $R^1$, $R^2$, $R^3$, and $R^4$ each independently represent a short-chain substituent group (α) of an aliphatic hydrocarbon group having 4 to 12 carbon atoms, or a long-chain substituent group (ß) of an aliphatic hydrocarbon group having 13 to 22 carbon atoms. The molar ratio of the short-chain substituent group (α) to the long-chain substituent group (ß), [(α)/(ß)] in all the molecules of the compound (D3) is 0.10 to 2.0. In the general formula (D-3), $X^1$, $X^2$, $X^3$, and $X^4$ each independently represent an oxygen atom or a sulfur atom.

Examples of the aliphatic hydrocarbon group having 4 to 12 carbon atoms that can be selected as the short-chain substituent group (c) include an alkyl group having 4 to 12 carbon atoms, and an alkenyl group having 4 to 12 carbon atoms.

Specific examples thereof include a butyl group, a pentyl group, a hexyl group, a heptyl group, an octyl group, a nonyl group, a decyl group, an undecyl group, a dodecyl group, a butenyl group, a pentenyl group, a hexenyl group, a heptenyl group, an octenyl group, a nonenyl group, a decenyl group, an undecenyl group and a dodecenyl group. These can be linear or branched.

The carbon number of the aliphatic hydrocarbon group that can be selected as the short-chain substituent group (α) is, from the viewpoint of more effectively exerting the advantageous effects of the present invention, preferably 5 to 11, more preferably 6 to 10, even more preferably 7 to 9.

Examples of the aliphatic hydrocarbon group having 13 to 22 carbon atoms that can be selected as the long-chain substituent group (ß) include an alkyl group having 13 to 22 carbon atoms, and an alkenyl group having 13 to 22 carbon atoms.

Specific examples thereof include a tridecyl group, a tetradecyl group, a pentadecyl group, a hexadecyl group, a heptadecyl group, an octadecyl group, a nonadecyl group, an eicosyl group, a heneicosyl group, a docosyl group, a tridecenyl group, a tetradecenyl group, a pentadecenyl group, a hexadecenyl group, a heptadecenyl group, an octadecenyl group, an oleyl group, a nonadecenyl group, an eicosenyl group, a heneicosenyl group, and a docosenyl group. These can be linear or branched.

The carbon number of the aliphatic hydrocarbon group that can be selected as the long-chain substituent group (ß) is, from the viewpoint of more effectively exerting the advantageous effects of the present invention, preferably 13 to 20, more preferably 13 to 16, even more preferably 13 to 14.

Here, the molar ratio of the short-chain substituent group (α) to the long-chain substituent group (ß), [(α)/(ß)] in all the molecules of the compound (D3) represented by the general formula (D-3) is 0.10 to 2.0. When the molar ratio [(α)/(ß)] is 0.10 or more, the influence of the compound (D3) on copper corrosion resistance is small and the friction reducing effect can be readily improved. Also when the molar ratio [(α)/(ß)] is 2.0 or less, the low-temperature storage stability can be more readily secured.

Here, from the viewpoint of reducing the influence on copper corrosion resistance, and from the viewpoint of more effectively improving the friction reducing effect, the molar ratio [(α)/(ß)] is preferably 0.15 or more, even more preferably 0.20 or more.

Also from the viewpoint of more effectively securing the low-temperature storage stability the molar ratio [(α)/(ß)] is preferably 1.2 or less, more preferably 1.0 or less, even more preferably 0.80 or less, further more preferably 0.60 or less.

The upper limit and the lower limit of the numerical range can be combined in any arbitrary manner. Specifically preferred is 0.15 to 1.2, more preferred is 0.20 to 1.0, even more preferred is 0.20 to 0.80, further more preferred is 0.20 to 0.60.

Here, the short-chain substituent group (α) and the long-chain substituent group (ß) can exist together in the same molecule or may not exist together therein. Namely an average value of the molar ratio of the short-chain substituent group (α) to the long-chain substituent group (ß), [(α)/(ß)] in all the molecules of the compound (D3) represented by the general formula (D-3) may need to fall within a range of 0.10 to 2.0.

Accordingly molecule groups (D3-1) where $R^1$, $R^2$, $R^3$ and $R^4$ in the general formula (D-3) are all the short-chain substituent group (α) can exist in the compound (D3) in a mixed manner therein, or molecule groups (D3-2) where $R^1$, $R^2$, $R^3$ and $R^4$ are all the long-chain substituent group (ß) can exist in a mixed manner therein, or molecule groups (D3-3) where a part of $R^1$, $R^2$, $R^3$ and $R^4$ are the short-chain substituent group (α) and the remaining part thereof are the long-chain substituent group (ß) can exist in a mixed manner therein.

Examples of the trinuclear molybdenum dithiocarbamate include compounds represented by the following general formula (D-4).

$$Mo_3S_kE_mL_nA_pQ_z \quad \text{(D-4)}$$

In the general formula (D-4), k represents an integer of 1 or more, m represents an integer of 0 or more, k+m is an integer of 4 to 10, and is preferably an integer of 4 to 7. n represents an integer of 1 to 4, p represents an integer of 0 or more. z represents an integer of 0 to 5, including a non-stoichiometric value.

E each independently represents an oxygen atom or a selenium atom, and for example, can be substituted with sulfur in the core to be mentioned below.

L each independently represents a anionic ligand having a carbon atom-containing organic group, and the total of the carbon atoms in the organic group in each ligand is 14 or more, and the ligands can be the same or different.

A each independently represents an anion except L.

Q each independently represents an electron-donating neutral compound, and exists to fill the empty coordination on the trinuclear molybdenum compound.

In the lubricating oil composition of the present embodiment, the content of the molybdenum-based friction modifier (D) is, from the viewpoint of attaining excellent fuel-saving performance by lowering the intermetallic friction coefficient, based on the total amount (100% by mass) of the lubricating oil composition, preferably 0.02% by mass or more, more preferably 0.05% by mass or more, even more preferably 0.08% by mass or more, and is preferably 5.0% by mass or less, more preferably 3.0% by mass or less, even more preferably 1.5% by mass or less.

The upper limit and the lower limit of these numerical ranges can be combined in any arbitrary manner. Specifically preferred is 0.02% by mass to 5.0% by mass, more preferred is 0.05% by mass to 3.0% by mass, even more preferred is 0.08% by mass to 1.5% by mass.

In the lubricating oil composition of the present embodiment, the content of the molybdenum atom derived from the molybdenum-based friction modifier (D) is, from the viewpoint of improving the friction-reducing effect and based on the total amount (100% by mass) of the lubricating oil composition, preferably 50 ppm by mass or more, more preferably 80 ppm by mass or more, even more preferably 100 ppm by mass or more, and is preferably 2,000 ppm by mass or less, more preferably 1,200 ppm by mass or less, even more preferably 800 ppm by mass or less. The upper limit and the lower limit of these numerical ranges can be combined in any arbitrary manner. Specifically, preferred is 50 to 2,000 ppm by mass, more preferred is 80 to 1,200 ppm by mass, even more preferred is 100 to 800 ppm by mass.

<Dispersant>

The lubricating oil composition of the present embodiment can further contain a dispersant. As the dispersant, one or more selected from non-boron-modified succinimides and boron-modified succinimides can be used, and preferably one or more selected from non-boron-modified succinimides and one or more selected from boron-modified succinimides are combined.

However, in the lubricating oil composition of the present embodiment, a dispersant may attract soot to a lubricated surface to worsen wear resistance, and therefore, the content of the dispersant is, based on the total amount (100% by mass) of the lubricating oil composition, preferably 12.00% by mass or less, more preferably 8.50% by mass or less, even more preferably 6.50% by mass or less.

Also the content of the nitrogen atom derived from the dispersant (more specifically the total amount of the nitrogen atoms derived from non-boron-modified succinimides and boron-modified succinimides) is, based on the total amount (100% by mass) of the lubricating oil composition, preferably 0.15% by mass or less, more preferably 0.12% by mass or less, even more preferably 0.10% by mass or less.

The nitrogen atom content can be measured according to JIS K 2609:1998.

<Other Components>

The lubricating oil composition of the present embodiment can contain any other components than the above-mentioned components, as needed and within a range not detracting from the advantageous effects of the present invention.

Examples of the additives as the other components include a metal-based detergent, a pour point depressant, an anti-wear agent, any other friction modifier than the molybdenum-based friction modifier (D), an extreme-pressure agent, a viscosity index improver, a rust inhibitor, an anti-foaming agent, an oiliness improver, a metal deactivator, and a demulsifier.

One alone or two or more kinds of these can be used either singly or as combined.

—Metal-Based Detergent—

Examples of the metal-based detergent include an organic acid metal salt compound containing a metal atom selected from an alkali metal and an alkaline earth metal, and specifically a metal salicylate, a metal phenate and a metal sulfonate containing a metal atom selected from an alkali metal and an alkaline earth metal.

In the present description, "alkali metal" indicates lithium, sodium, potassium, rubidium and cesium.

"Alkaline earth metal" indicates beryllium, magnesium, calcium, strontium and barium.

The metal atom contained in the metal-based detergent is, from the viewpoint of improving detergency at high temperatures, preferably sodium, calcium, magnesium or barium, more preferably calcium or magnesium.

The metal salicylate is preferably a compound represented by the following general formula (1), the metal phenate is preferably a compound represented by the following formula (2), and the metal sulfonate is preferably a compound represented by the following general formula (3).

(1)

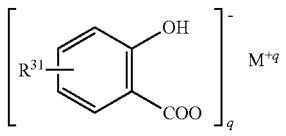

-continued (2)

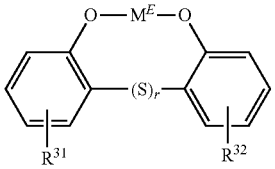

(3)

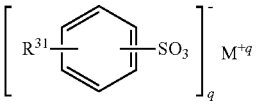

In the above general formulae (1) to (3), M represents a metal atom selected from an alkali metal and an alkaline earth metal, and is preferably sodium, calcium, magnesium or barium, more preferably calcium or magnesium. $M^E$ represents an alkaline earth metal, and is preferably calcium, magnesium or barium, more preferably calcium or barium. q is a valence of M, and is 1 or 2. $R^{31}$ and $R^{32}$ each independently represent a hydrogen atom or a hydrocarbon group having 1 to 18 carbon atoms. S represents a sulfur atom. r represents an integer of 0 or more, and is preferably an integer of 0 to 3.

Examples of the hydrocarbon group that $R^{31}$ and $R^{32}$ can represent include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

One alone or two or more kinds of these can be used either singly or as combined. Among these, from the viewpoint of improving high-temperature detergent dispersibility and from the viewpoint of solubility in base oil, preferred is one or more selected from calcium salicylate, calcium phenate, calcium sulfonate, magnesium salicylate, magnesium phenate and magnesium sulfonate.

These metal-based detergents can be any of a neutral salt, a basic salt, an overbased salt and a mixture thereof.

The base number of the metal-based detergent is preferably 0 to 600 mg KOH/g.

In the case where the metal-based detergent is a basic salt or an overbased salt, the base number of the metal-based detergent is preferably 10 to 600 mg KOH/g, more preferably 20 to 500 mg KOH/g.

In the present description, the "base number" means a base number measured in a perchloric acid method according to "7" of JIS K2501:2003 "Test Method for Neutralization Titer for Petroleum Products and Lubricating Oils".

In the lubricating oil composition of the present embodiment, the content of the metal-based detergent is, from the viewpoint of more readily exerting the advantageous effects of the present invention and based on the total amount (100% by mass) of the lubricating oil composition, preferably 0.01% by mass to 10% by mass, more preferably 0.1% by mass to 5.0% by mass, even more preferably 0.2% by mass to 3.0% by mass, further more preferably 0.3% by mass to 2.0% by mass.

The metal-based detergent can be used singly, or two or more kinds thereof can be used as combined. A preferred total content in the case of using two or more kinds is also the same as the above-mentioned content.

In the lubricating oil composition of the present embodiment where the metal atom contained in the metal-based detergent is calcium, the content of the calcium atom derived from the metal-based detergent is, from the viewpoint of high-temperature detergency and dispersibility, based on the total amount (100% by mass) of the lubricating oil composition, preferably 0.05% by mass or more, more preferably 0.10% by mass or more, even more preferably 0.11% by mass or more.

Also the content of the calcium atom derived from the metal-based detergent is, from the viewpoint of reducing the sulfated ash content, from the viewpoint of preventing LSPI (low-speed pre-ignition), based on the total amount (100% by mass) of the lubricating oil composition, preferably 0.50% by mass or less, more preferably 0.40% by mass or less, even more preferably 0.30% by mass or less, further more preferably 0.20% by mass or less, further more preferably 0.15% by mass or less, further more preferably 0.13% by mass or less.

In the lubricating oil composition of the present embodiment where the metal atom contained in the metal-based detergent is magnesium, the content of the magnesium atom derived from the metal-based detergent is, from the viewpoint of high-temperature detergency and dispersibility, based on the total amount (100% by mass) of the lubricating oil composition, preferably 0.02% by mass or more, more preferably 0.03% by mass or more, even more preferably 0.04% by mass or more.

Also the content of the magnesium atom derived from the metal-based detergent is, from the viewpoint of reducing the sulfated ash content, from the viewpoint of preventing LSPI (low-speed pre-ignition) and based on the total amount (100% by mass) of the lubricating oil composition, preferably 0.07% by mass or less, more preferably 0.06% by mass or less, even more preferably 0.05% by mass or less.

—Pour Point Depressant—

Examples of the pour point depressant include an ethylene-vinyl acetate copolymer, a condensed product of a chlorinated paraffin and a naphthalene, a condensed product of a chlorinated paraffin and a phenol, a polymethacrylate compound (PMA compound: e.g., polyalkyl (meth)acrylate), a polyvinyl acetate, a polybutene, and a polyalkylstyrene. A polymethacrylate compound is preferably used. The weight-average molecular weight (Mw) of the polymer used as a pour point depressant is preferably 50,000 to 150,000.

One alone or two or more kinds of these can be used either singly or as combined.

—Antioxidant—

Examples of the antioxidant include an amine-type antioxidant and a phenol-type antioxidant.

Examples of the amine-type antioxidant include a diphenylamine-type antioxidant such as diphenylamine, and an alkylated diphenylamine having an alkyl group with 3 to 20 carbon atoms; and a naphthylamine-type antioxidant such as a phenyl-α-naphthylamine, a phenyl-8-naphthylamine, a substituted phenyl-α-naphthylamine having an alkyl group with 3 to 20 carbon atoms, and a substituted phenyl-8-naphthylamine having an alkyl group with 3 to 20 carbon atoms.

Examples of the phenol-type antioxidant include a monophenol-type antioxidant such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, and octadecyl-3-(3,5-di-tert-butyl-4-hydroxyphenyl)propionate; a diphenol-type antioxidant such as 4,4'-methylenebis(2,6-di-tert-butylphenol), 2,2'-methylenebis(4-ethyl-6-tert-butylphenyl); and a hindered phenol-type antioxidant.

One alone or two or more kinds of these can be used either singly or as combined.

—Anti-Wear Agent—

Examples of the anti-wear agent include zinc-containing compounds such as a zinc dialkyldithiophosphate (ZnDTP), and a zinc phosphate; sulfur-containing compounds such as disulfides, olefin sulfides, sulfurized oils and fats, sulfurized esters, thiocarbonates, thiocarbamates, and polysulfides; phosphorus-containing compounds such as phosphites, phosphates, phosphonates, and amine salts or metal salts thereof; and sulfur and phosphorus-containing anti-wear agents such as thiophosphites, thiophosphates, thiophosphonates, and amine salts or metal salts thereof.

Among these, preferred is a zinc dialkyldithiophosphate (ZnDTP).

One alone or two or more kinds of these can be used either singly or as combined.

The content of the zinc dithiophosphate is, in terms of the phosphorus atom based on the total amount of the composition, preferably 200 to 5,000 ppm by mass, more preferably 300 to 2,000 ppm by mass.

—Friction Modifier Except Component (D)—

The lubricating oil composition of the present embodiment can contain any other friction modifier than the component (D).

The component (D) is excellent in effectively exerting the friction-reducing effect in an environment in which the temperature of the lubricating oil composition is high, but when the lubricating oil composition further contains any other friction modifier than the component (B), the composition can effectively exert the friction-reducing effect even in an environment in which the temperature of the lubricating oil composition is low.

Examples of the other friction modifier than the molybdenum-based friction modifier (D) include ash-free friction modifiers such as aliphatic amines, fatty acid esters, fatty acid amides, fatty acids, aliphatic alcohols, and aliphatic ethers; oils and fats, amines, amides, sulfated esters, phosphates, phosphites, and phosphate amine salts.

One alone or two or more kinds of these can be used either singly or as combined.

Here, as the friction modifier except the component (D), preferred are aliphatic amines, and among aliphatic amines, preferred are aliphatic amines having at least one alkyl or alkenyl group with 2 to 30 carbon atoms in the molecule.

Among the aliphatic amines having at least one alkyl or alkenyl group with 2 to 30 carbon atoms in the molecule, preferred are diethanolamine compounds represented by the following general formula (4).

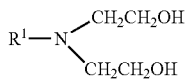

(4)

In the general formula (4), $R^1$ represents a monovalent aliphatic hydrocarbon group having 12 to 30 carbon atoms.

The aliphatic hydrocarbon group having 12 to 30 carbon atoms of $R^1$ is, for example, preferably a linear or branched alkyl group having 12 to 30 carbon atoms, or a linear or branched alkenyl group having 12 to 30 carbon atoms. The carbon number of these groups is more preferably 12 to 24, even more preferably 16 to 20.

Examples of the linear or branched alkyl group having 12 to 30 carbon atoms include various dodecyl groups such as an n-dodecyl group, an isododecyl group, a sec-dodecyl group, a tert-dodecyl group and a neododecyl group (hereinafter functional groups having a predetermined carbon number including linear and branched groups and isomers thereof may be abbreviated as "various functional groups"), various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl groups, various tricosyl groups, various tetracosyl groups, various pentacosyl groups, various hexacosyl groups, various heptacosyl groups, various octacosyl groups, various nonacosyl groups, and various triacontyl groups.

Examples of the linear or branched alkenyl group having 12 to 30 carbon atoms include various dodecenyl groups, various tridecenyl groups, various tetradecenyl groups, various pentadecenyl groups, various hexadecenyl groups, various heptadecenyl groups, various octadecenyl groups, various nonadecenyl groups, various eicosenyl groups, various heneicosenyl groups, various dodecenyl groups, various tricosenyl groups, various tetracosenyl groups, various pentacosenyl group, various hexacosenyl groups, various heptacosenyl groups, various octacosenyl groups, various nonacosenyl groups, and various triacontenyl groups.

Above all, in consideration of the effect of improving long drain performance, preferred are various hexadecyl groups, various heptadecyl groups and various octadecyl groups of an alkyl group having 16 to 18 carbon atoms, and various hexadecenyl groups, various heptadecenyl groups and various octadecenyl groups of an alkenyl group having 16 to 18 carbon atoms; more preferred are various hexadecyl groups, various octadecyl groups and various octadecenyl groups; and even more preferred are an n-hexadecyl group (palmityl group), an n-octadecyl group (stearyl group), and an n-octadecenyl group (oleyl group).

Specifically preferred examples of the diethanolamine compound represented by the general formula (4) include one or more selected from stearyldiethanolamine (in the general formula (4), $R^1$ is an n-octadecyl group (stearyl group)), oleyldiethanolamine (in the general formula (4), $R^1$ is an n-octadecenyl group (oleyl group)), and palmityldiethanolamine (in the general formula (4), $R^1$ is an n-hexadecyl group (palmityl group)). Among these, oleyldiethanolamine is preferred.

One alone or two or more kinds of these can be used either singly or as combined.

—Extreme-Pressure Agent—

Examples of the extreme-pressure agent includes sulfur-based extreme-pressure agents such as sulfides, sulfoxides, sulfones and thiophosphinates; halogen-based extreme pressure agents such as chlorinated hydrocarbons; and organic metal-based extreme pressure agents. Among the above-mentioned anti-wear agents, those having a function as an extreme pressure agents are also usable.

One alone or two or more kinds of these can be used either singly or as combined.

—Rust Inhibitor—

Examples of the rust inhibitor include fatty acids, alkenylsuccinic acid half esters, fatty acid soaps, alkylsulfonate salts, polyalcohol fatty acid esters, fatty acid amines, oxidized paraffins, and alkylpolyoxyethylene ethers.

One alone or two or more kinds of these can be used either singly or as combined.

—Anti-Foaming Agent—

Examples of the anti-foaming agent include silicone oils such as dimethylpolysiloxanes; fluorosilicone oils, and fluoroalkyl ethers.

One alone or two or more kinds of these can be used either singly or as combined.

—Oiliness Improver—

Examples of the oiliness improver include aliphatic saturated or unsaturated monocarboxylic acids such as stearic acid and oleic acid; polymer fatty acids such as dimer acids and hydrogenated dimer acids; hydroxyfatty acids such as ricinoleic acid and 12-hydroxystearic acid; aliphatic saturated or unsaturated monoalcohols such as lauryl alcohol and oleyl alcohol; aliphatic saturated or unsaturated monoamines such as stearylamine and oleylamine; aliphatic saturated or unsaturated monocarboxylic acid amides such as lauramide and oleamide; partial esters of polyalcohols such as glycerin or sorbitol and aliphatic saturated or unsaturated monocarboxylic acids.

—Metal Deactivator—

Examples of the metal deactivator include benzotriazole compounds, tolyltriazole compounds, thiadiazole compounds, imidazole compounds, and pyrimidine compounds.

One alone or two or more kinds of these can be used either singly or as combined.

—Demulsifier—

Examples of the demulsifier include anionic surfactants, such as salts of sulfates such as castor oil, and salts of petroleum sulfonates; cationic surfactants such as quaternary ammonium salts and imidazolines; polyalkylene glycol-type nonionic surfactants such as polyoxyethylene alkyl ethers, polyoxyethylene alkyl phenyl ethers, and polyoxyethylene alkyl naphthyl ethers; polyoxyalkylene polyglycols and esters thereof with dicarboxylic acids; alkylene oxide adducts of alkyl phenol-formaldehyde polycondensates.

One alone or two or more kinds of these can be used either singly or as combined.

The content of the other components mentioned above can be appropriately controlled within a range not detracting from the advantageous effects of the present invention, and each is, based on the total amount (100% by mass) of the lubricating oil composition, generally 0.001% by mass to 15% by mass, preferably 0.005% by mass to 10% by mass, more preferably 0.01% by mass to 7% by mass, even more preferably 0.03% by mass to 5% by mass.

In the present description, the additives as the above-mentioned other components can be blended with the other components in the form of a solution prepared by diluting and dissolving it in a part of the above-mentioned base oil (A), in consideration of the handleability and the solubility in the base oil (A). In such a case, in the present description, the content of the additives as the above-mentioned other components means a content in terms of the active ingredient (as solid) excluding the diluting oil.

[Physical Data of Lubricating Oil Composition]

<100° C. Kinematic Viscosity and Viscosity Index>

Regarding the 100° C. kinematic viscosity of the lubricating oil composition of the present embodiment, the upper limit thereof is, from the viewpoint of bettering fuel-saving performance, and the lower limit thereof is, from the viewpoint of reducing the loss of the lubricating oil composition by evaporation to secure oily film retentiveness, preferably 4.5 $mm^2/s$ or more, more preferably 5.0 $mm^2/s$ or more, even more preferably 6.1 $mm^2/s$ or more, and is preferably 21.9 $mm^2/s$ or less, more preferably 16.3 $mm^2/s$ or less, even more preferably 12.5 $mm^2/s$ or less. The upper limit and the lower limit of these numerical ranges can be combined in any arbitrary manner. Specifically preferred is 4.5 to 21.9 $mm^2/s$, more preferred is 5.0 to 16.3 $mm^2/s$, even more preferred is 6.1 to 12.5 $mm^2/s$.

The viscosity index of the lubricating oil composition of the present embodiment is preferably 120 or more, more preferably 140 or more, even more preferably 160 or more, further more preferably 180 or more. When the viscosity index falls with the range, viscosity change with temperature is small.

The 40° C. kinematic viscosity, the 100° C. kinematic viscosity and the viscosity index can be measured or calculated according to JIS K 2283:2000.

[Nitrogen Atom Content]

The nitrogen atom content in the lubricating oil composition of the present embodiment is, from the viewpoint of maintaining high-temperature detergent dispersibility for a long period of time, based on the total amount (100% by mass) of the lubricating oil composition, preferably 0.03% by mass or more, more preferably 0.04% by mass or more. Also the nitrogen atom content is, from the viewpoint of viscosity reduction, based on the total amount (100% by mass) of the lubricating oil composition, preferably 0.20% by mass or less, more preferably 0.15% by mass or less, even more preferably 0.10% by mass or less, further more preferably 0.09% by mass or less.

The nitrogen atom content can be measured according to JIS K 2609:1998.

[150° C. HTHS Viscosity ($HTHS_{150}$)]

The 150° C. HTHS Viscosity ($HTHS_{150}$) of the lubricating oil composition of the present embodiment is preferably 2.0 mPa·s or more, more preferably 2.3 mPa·s or more, and is preferably less than 3.7 mPa·s, more preferably less than 3.0 mPa·s.

The 150° C. HTHS Viscosity ($HTHS_{150}$) of the lubricating oil composition of the present embodiment can be measured according to ASTM D4683, using a TBS high-temperature viscometer (Tapered Bearing Simulator Viscometer) at a shear rate of $10^6/s$.

The wear track of the lubricating oil composition of the present embodiment in a wear resistance test using an HFRR tester is preferably 200 μm or less, more preferably 165 μm or less.

The wear track in wear resistance test using an HFRR tester indicates the wear track measured according to the method described in Examples given hereinunder.

[Use of Lubricating Oil Composition]

The lubricating oil composition of the present embodiment has an excellent friction coefficient reducing effect.

Accordingly the lubricating oil composition of the present invention is favorably used for internal combustion engines, more preferably for internal combustion engines of four-wheeled vehicles and motorcycles.

The lubricating oil composition of the present embodiment is favorably used as an engine oil, more preferably for a diesel engine oil.

The lubricating oil composition of the present embodiment is preferred for use as an internal combustion engine lubricating oil composition for use for vehicles and the like (engine oils for internal combustion engines), but is also applicable to other uses.

[Production Method for Lubricating Oil Composition]

The production method for the lubricating oil composition of the present embodiment is not specifically limited.

For example, the production method for the lubricating oil composition of the present embodiment includes a step of mixing the base oil (A) and the dispersant-type viscosity index improver (B). As needed, one or more selected from the non-dispersant-type viscosity index improver (C), the molybdenum-based friction modifier (D) and other components can be mixed therein.

The method of mixing the above-mentioned components is not specifically limited. One example of the method includes a step of blending the components (one or more selected from the component (B), the component (C), the component (D) and the above-described other components) in the base oil (A). The components can be blended after diluted with a diluting oil or the like to be a solution (dispersion). After the components have been blended, preferably they are stirred and dispersed uniformly according to a known method.

[Engine]

The present embodiment also provides an engine containing the lubricating oil composition of the present invention mentioned above.

As mentioned above, the engine includes engines for vehicles such as motor vehicles, and preferred are engines for motor vehicles, more preferred are diesel engines for motor vehicles.

The lubricating oil composition of the present embodiment can exert excellent wear resistance even in diesel engines that may be contaminated with soot.

[Lubrication Method for Engines]

The present invention also provides an engine lubrication method of lubricating engines, using the lubricating oil composition of the present embodiment mentioned hereinabove.

As also mentioned above, the engines include engines for vehicles such as motor vehicles, and preferred are engines for motor vehicles, more preferred are diesel engines for motor vehicles in which the lubricating oil composition may be contaminated with soot.

The lubricating oil composition of the present invention can improve wear resistance between metal members in an environment that may be contaminated with soot. Accordingly according to the lubrication method for engines of the present embodiment, excellent wear resistance between metal members can be imparted to engines.

Embodiments of the Invention Provided Herein

The present invention can provide the following embodiments [1] to [18].

[1] A lubricating oil composition containing a base oil (A) and a dispersant-type viscosity index improver (B), in which the nitrogen atom content based on the solid content of the dispersant-type viscosity index improver (B) is 0.50 to 1.50% by mass, and the weight-average molecular weight (Mw) thereof is 100,000 or more, and the content in terms of the solid content based on the total amount of the composition of the dispersant-type viscosity index improver (B) is more than 0.05% by mass and less than 5.0% by mass.

[2] The lubricating oil composition according to [1], in which the weight-average molecular weight (Mw) of the dispersant-type viscosity index improver (B) is 250,000 or less.

[3] The lubricating oil composition according to [1] or [2], further containing a non-dispersant-type viscosity index improver (C) having the weight-average molecular weight (Mw) of 200,000 or more, in an amount of 0.2 to 10.0% by mass in terms of the solid content based on the total amount of the composition.

[4] The lubricating oil composition according to [3], in which the ratio of the content of the non-dispersant-type viscosity index improver (C) to the content of the dispersant-type viscosity index improver (B), [(C)/(B)] is, as a ratio by mass of the solid content, 0.50 to 20.0 times.

[5] The lubricating oil composition according to any of [1] to [4], in which n the kinematic viscosity at 100° C. is 3.0 to 16.0 $mm^2/s$.

[6] The lubricating oil composition according to any of [1] to [5], in which the viscosity index is 150 or more.

[7] The lubricating oil composition according to any of [1] to [6], in which the molecular weight distribution (Mw/Mn) of the dispersant-type viscosity index improver (B) is 3.0 or less.

[8] The lubricating oil composition according to any of [1] to [7], further containing a molybdenum-based friction modifier (D).

[9] The lubricating oil composition according to [8], in which the content of the molybdenum-based friction modifier (D) is 50 to 2,000 ppm by mass in terms of the molybdenum atom based on the total amount of the composition.

[10] The lubricating oil composition according to any of [1] to [9], further containing zinc dithiophosphate.

[11] The lubricating oil composition according to [10], in which the content of the zinc dithiophosphate is 200 to 5,000 ppm by mass in terms of the phosphorus atom based on the total amount of the composition.

[12] The lubricating oil composition according to any of [1] to [11], in which the content of a dispersant-derived nitrogen atom is 0.10% by mass or less based on the total amount of the composition.

[13] The lubricating oil composition according to [12], in which the content of the dispersant-derived nitrogen atom is a total amount of the nitrogen atom derived from a non-boron-modified succinimide and a boron-modified succinimide.

[14] The lubricating oil composition according to any of [1] to [13], in which the content of the base oil (A) is 60 to 99% by mass based on the total amount of the composition.

[15] The lubricating oil composition according to any of [1] to [14], which is used for diesel engines.

[16] A method for producing the lubricating oil composition according to any of [1] to [15], including a step of mixing the base oil (A) and the dispersant-type viscosity index improver (B).

[17] A diesel engine containing the lubricating oil composition according to any of [1] to [15].

[18] A method for lubricating an engine using the lubricating oil composition according to any of [1] to [15].

EXAMPLES

The present invention is described more specifically with reference to the following Examples, but the present invention is not limited to the following Examples. Various properties of the components used in Examples and Comparative Examples and those of the lubricating oil compositions obtained therein were measured according to the following methods.

[40° C. Kinematic Viscosity 100° C. Kinematic Viscosity, and Viscosity Index]

The 40° C. kinematic viscosity, the 100° C. kinematic viscosity and the viscosity index of the lubricating oils were measured or calculated according to JIS K 2283:2000.

[150° C. HTHS Viscosity]

The 150° C. HTHS viscosity was measured or calculated according to JPI-5S-36-03.

[Content of Molybdenum Atom and Phosphorus Atom]

The content of a molybdenum atom and a phosphorus atom was measured according to JPI-5S-38-03.

[Measurement of Weight-Average Molecular Weight (Mw)]

The weight-average molecular weight (Mw) as a polystyrene-equivalent one was measured according to a gel permeation chromatography (GPC) method.

Examples 1 to 11, Comparative Examples 1 to 6

The components shown below were well mixed in the content ratio shown in Table 1 to Table 2 to prepare lubricating oil compositions.

Details of the contents used in Examples 1 to 11 and Comparative Examples 1 to 6 are shown below.

The content in Table 1 to Table 2 is a content in terms of solid content.

<Base Oil (A)>

Mineral oil (Classification in API base oil category: Group III, 40° C. kinematic viscosity: 19.8 $mm^2/s$, 100° C. kinematic viscosity: 4.0 $mm^2/s$, viscosity index: 125)

<Dispersant-Type Viscosity Index Improver>

[Dispersant-Type Viscosity Index Improver Corresponding to Component (B)]

Dispersant-type olefin copolymer (weight-average molecular weight (Mw): 120,000, molecular weight distribution (Mw/Mn): 2.0, solid content-based nitrogen atom content: 0.77% by mass, a nitrogen-containing olefin-based copolymer having the following repeating unit)

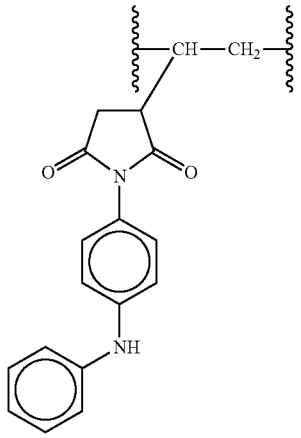

Dispersant-type polymethacrylate 1 (weight-average molecular weight (Mw): 240,000, molecular weight distribution (Mw/Mn): 2.5, solid content-based nitrogen atom content: 1.05% by mass, nitrogen-containing poly(meth)acrylate, comonomer: N-vinyl-2-pyrrolidone)

[Other Dispersant-Type Viscosity Index Improvers]

Dispersant-type polymethacrylate 2 (weight-average molecular weight (Mw): 90,000, molecular weight distribution (Mw/Mn): 3.5, solid content-based nitrogen atom content: 0.46% by mass, comonomer: ethylaminoethyl (meth)acrylate)

Dispersant-type polymethacrylate 3 (weight-average molecular weight (Mw): 57,000, molecular weight distribution (Mw/Mn): 2.2, solid content-based nitrogen atom content: 1.20% by mass, comonomer: ethylaminoethyl (meth)acrylate)

Dispersant-type polymethacrylate 4 (weight-average molecular weight (Mw): 38,900, molecular weight distribution (Mw/Mn): 6.5, solid content-based nitrogen atom content: 0.27% by mass, comonomer: ethylaminoethyl (meth)acrylate)

Dispersant-type polymethacrylate 5 (weight-average molecular weight (Mw): 140,000, molecular weight distribution (Mw/Mn): 5.4, solid content-based nitrogen atom content: 0.34% by mass, comonomer: N-vinyl-2-pyrrolidone)

Dispersant-type polymethacrylate 6 (weight-average molecular weight (Mw): 143,000, molecular weight distribution (Mw/Mn): 2.4, solid content-based nitrogen atom content: 0.49% by mass, comonomer: N-vinyl-2-pyrrolidone)

<Non-Dispersant-Type Viscosity Index Improver (C)>

Non-dispersant-type polymethacrylate 1 (weight-average molecular weight (Mw): 310,000, molecular weight distribution (Mw/Mn): 2.5)

Non-dispersant-type polymethacrylate 2 (weight-average molecular weight (Mw): 310,000, molecular weight distribution (Mw/Mn): 1.9)

<Molybdenum-Based Friction Modifier (D)>

Molybdenum dithiocarbamate: molybdenum dialkyl dithiocarbamate represented by the following structural formula (MoDTC, molybdenum atom content: 10.0% by mass)

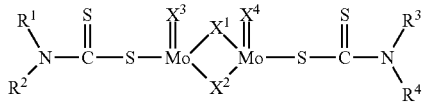

In the above structural formula, $R^1$, $R^2$, $R^3$ and $R^4$ each are independently selected from an isooctyl group (carbon number 8: short-chain substituent group) and an isotridecyl group (carbon number 13: long-chain substituent group), and the molar ratio of the isooctyl group to the isotridecyl group in all molecules of molybdenum dialkyl dithiocarbamate is 50/50. $X^1$ and $X^2$ are sulfur atoms, and $X^3$ and $X^4$ are oxygen atoms.

<Dispersant>

Dispersant 1: Non-boron-modified polyisobutenyl succinbisimide (mass-average molecular weight (Mw) of polyisobutenyl group: 2,300, nitrogen atom content: 1.0% by mass Dispersant 2: Boron-modified polyisobutenyl succinimide (polybutene skeleton, mass-average molecular weight (Mw) of polyisobutenyl group: 2,300, nitrogen atom content: 1.4% by mass, boron atom content: 1.3% by mass <Other Components>

Pour point depressant, antioxidant, zinc dialkyl dithiophosphate (ZnDTP), metal deactivator.

[Atom Content]

In Table 1 to Table 2, the molybdenum atom content in the lubricating oil composition is a value that reflects the content of the molybdenum atom derived from the molybdenum-based friction modifier (D).

In Table 1 to Table 2, the phosphorus atom content in the lubricating oil composition is a value that reflects the content of the phosphorus atom derived from the other additive, ZnDTP.

To 100 parts by mass of the lubricating oil composition obtained in Examples 1 to 11 and Comparative Examples 1 to 6, 3 parts by mass of carbon black was added to prepare a sample oil, and the sample oil was evaluated as follows. The results are shown in Table 1 to Table 2.

[Evaluation of Wear Resistance]

Using an HFRR tester (by PCS Instruments Ltd.), the prepared lubricating oil composition was tested to measure the wear track under the condition mentioned below. The wear track is an average value of the wear track diameter in the parallel direction relative to the sliding direction, and the wear track diameter in the orthogonal direction thereto.

Test piece: upper ball (made of 52100 steel), lower disc (800 HV)
Amplitude: 1.0 mm
Frequency: 20 Hz
Load: 1000 g
Temperature: 85° C.
Test time: 20 minutes

TABLE 1

| | | | Example | | | | Comparative Example | | | | | |
|---|---|---|---|---|---|---|---|---|---|---|---|---|
| | | | 1 | 2 | 3 | 4 | 1 | 2 | 3 | 4 | 5 | 6 |
| Base Oil (A) | Mineral Oil | mass % | 83.04 | 82.93 | 83.04 | 82.93 | 83.25 | 81.88 | 82.25 | 82.70 | 82.10 | 81.77 |
| Dispersant-type Viscosity Index Improver | Dispersant-type Olefin Copolymer | mass % | 0.21 | 0.32 | | | | | | | | |
| | Dispersant-type Polymethacrylate 1 | mass % | | | 0.21 | 0.32 | | | | | | |
| | Dispersant-type Polymethacrylate 2 | mass % | | | | | | 1.37 | | | | |
| | Dispersant-type Polymethacrylate 3 | mass % | | | | | | | 1.00 | | | |
| | Dispersant-type Polymethacrylate 4 | mass % | | | | | | | | 0.55 | | |
| | Dispersant-type Polymethacrylate 5 | mass % | | | | | | | | | 1.15 | |
| | Dispersant-type Polymethacrylate 6 | mass % | | | | | | | | | | 1.48 |
| Non-dispersant-type Viscosity Index Improver (C) | Non-dispersant-type polymethacrylate 1 | mass % | 2.1 | 2.1 | 2.1 | 2.1 | 2.1 | 2.1 | 2.1 | 2.1 | 2.1 | 2.1 |
| | Non-dispersant-type polymethacrylate 2 | mass % | | | | | | | | | | |
| Molybdenum-based Friction Modifier (D) | Molybdenum dithiocarbamate | mass % | 0.45 | 0.45 | 0.45 | 0.45 | 0.45 | 0.45 | 0.45 | 0.45 | 0.45 | 0.45 |
| Dispersant | Dispersant 1 | mass % | 5.50 | 5.50 | 5.50 | 5.50 | 5.50 | 5.50 | 5.50 | 5.50 | 5.50 | 5.50 |
| | Dispersant 2 | mass % | 2.00 | 2.00 | 2.00 | 2.00 | 2.00 | 2.00 | 2.00 | 2.00 | 2.00 | 2.00 |
| Other components | | mass % | 6.7 | 6.7 | 6.7 | 6.7 | 6.7 | 6.7 | 6.7 | 6.7 | 6.7 | 6.7 |
| Total | | mass % | 100.00 | 100.00 | 100.00 | 100.00 | 100.00 | 100.00 | 100.00 | 100.00 | 100.00 | 100.00 |
| Physical Data | 40° C. Kinematic Viscosity | $mm^2/s$ | 42.5 | 46.7 | 42.8 | 46.9 | 44.8 | 43.6 | 44.1 | 38.2 | 46.1 | 46.0 |
| | 100° C. Kinematic Viscosity | $mm^2/s$ | 9.0 | 9.7 | 9.8 | 10.8 | 9.6 | 10.0 | 10.3 | 8.8 | 10.6 | 10.3 |
| | Viscosity Index | — | 202 | 199 | 224 | 230 | 139 | 224 | 231 | 222 | 229 | 222 |
| | 150° C. HTHS Viscosity | mPa · s | | 3.0 | 3.0 | 3.2 | 2.9 | 3.2 | 3.2 | 2.9 | 3.1 | 3.0 |
| Atom Content in Lubricating Oil Composition | Molybdenum | mass % | 0.04 | 0.04 | 0.04 | 0.04 | 0.04 | 0.04 | 0.04 | 0.04 | 0.04 | 0.04 |
| | Phosphorus | mass % | 0.07 | 0.07 | 0.07 | 0.07 | 0.07 | 0.07 | 0.07 | 0.07 | 0.07 | 0.07 |
| | Dispersant-derived Nitrogen | mass % | 0.08 | 0.08 | 0.08 | 0.08 | 0.08 | 0.08 | 0.08 | 0.08 | 0.08 | 0.08 |
| Wear Resistance Evaluation | Wear Track Diameter (HFRR Test) | μm | 149 | 144 | 155 | 153 | 228 | 208 | 217 | 198 | 210 | 202 |

TABLE 2

| | | | Example | | | | | | |
|---|---|---|---|---|---|---|---|---|---|
| | | | 5 | 6 | 7 | 8 | 9 | 10 | 11 |
| Base Oil (A) | | mass % | 83.84 | 83.79 | 83.98 | 83.38 | 87.63 | 80.63 | 85.34 |
| Dispersant-type Viscosity Index Improver | Dispersant-type Olefin Copolymer | mass % | 0.11 | | | | | | 0.11 |
| | Dispersant-type Polymethacrylate 1 | mass % | | 0.16 | 0.32 | 0.32 | 0.32 | 0.32 | |
| | Dispersant-type Polymethacrylate 2 | mass % | | | | | | | |
| | Dispersant-type Polymethacrylate 3 | mass % | | | | | | | |
| | Dispersant-type Polymethacrylate 4 | mass % | | | | | | | |
| | Dispersant-type Polymethacrylate 5 | mass % | | | | | | | |
| | Dispersant-type Polymethacrylate 6 | mass % | | | | | | | |

TABLE 2-continued

| | | | Example | | | | | | |
|---|---|---|---|---|---|---|---|---|---|
| | | | 5 | 6 | 7 | 8 | 9 | 10 | 11 |
| Non-dispersant-type Viscosity Index Improver (C) | Non-dispersant-type polymethacrylate 1 | mass % | | | | | | | |
| | Non-dispersant-type polymethacrylate 2 | mass % | 1.4 | 1.4 | 1.4 | 1.4 | 1.4 | 1.4 | 1.4 |
| Molybdenum-based Friction Modifier (D) | Molybdenum dithiocarbamate | mass % | 0.45 | 0.45 | 0.10 | 0.70 | 0.45 | 0.45 | 0.45 |
| Dispersant | Dispersant 1 | mass % | 5.50 | 5.50 | 5.50 | 5.50 | 1.50 | 8.50 | 4.00 |
| | Dispersant 2 | mass % | 2.00 | 2.00 | 2.00 | 2.00 | 2.00 | 2.00 | 2.00 |
| Other Components | | mass % | 6.7 | 6.7 | 6.7 | 6.7 | 6.7 | 6.7 | 6.7 |
| Total | | mass % | 100.00 | 100.00 | 100.00 | 100.00 | 100.00 | 100.00 | 100.00 |
| Physical Data | 40° C. Kinematic Viscosity | $mm^2/s$ | 32.6 | 31.7 | 33.3 | 32.6 | 31.5 | 32.3 | 31.5 |
| | 100° C. Kinematic Viscosity | $mm^2/s$ | 7.2 | 7.0 | 7.6 | 7.2 | 7.0 | 7.4 | 7.1 |
| | Viscosity Index | — | 196 | 192 | 206 | 196 | 207 | 207 | 199 |
| | 150° C. HTHS Viscosity | mPa · s | 2.6 | 2.6 | 2.6 | 2.6 | 2.6 | 2.6 | 2.6 |
| Atom Content in Lubricating Oil Composition | Molybdenum | mass % | 0.04 | 0.04 | 0.01 | 0.07 | 0.04 | 0.04 | 0.04 |
| | Phosphorus | mass % | 0.07 | 0.07 | 0.07 | 0.07 | 0.07 | 0.07 | 0.07 |
| | Dispersant-derived Nitrogen | mass % | 0.08 | 0.08 | 0.08 | 0.08 | 0.05 | 0.11 | 0.07 |
| Wear Resistance Evaluation | Wear Track Diameter (HFRR Test) | μm | 157 | 158 | 141 | 162 | 148 | 161 | 145 |

As known from Tables 1 to 2, the lubricating oil compositions of Examples 1 to 11 that satisfy all the constitutions in the present invention are such that the results in the wear resistance evaluation test are 165 μm or less, even in the state added with carbon black that simulates a state in which soot has been generated due to degradation of lubricating oil assumed in diesel engine oil, and are known to be excellent in wear resistance.

On the other hand, the lubricating oil compositions of Comparative Examples 1 to 6 are known to have lower wear resistance than the lubricating oil compositions of Examples 1 to 11.

The invention claimed is:

1. A lubricating oil composition, comprising:

a base oil that is present in a range of from 60% to 99% by mass, based on a total amount of the lubricating oil composition;

a dispersant-type viscosity index improver selected from the group consisting of a dispersant-type nitrogen-containing poly(meth)acrylate and a dispersant-type nitro-containing polyolefin and having a weight-average molecular weight in a range of 120,000 to 240,000;

a non-dispersant-type viscosity index improver which is a non-dispersant-type poly(meth)acrylate having a weight-average molecular weight in a range of 280,000 to 310,000; and a molybdenum-based friction modifier which is a binuclear molybdenum dithiocarbamate selected from the group consisting of a compound of formula (D-1) and a compound of formula (D-2), (D-1)

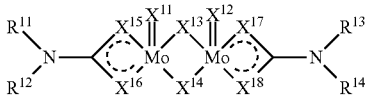

-continued (D-2)

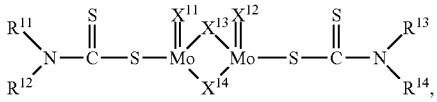

where $R^{11}$ to $R^{14}$ each independently are a hydrocarbon group having 6 to 22 carbon atoms, $X^{11}$ to $X^{18}$ each independently are an oxygen atom or a sulfur atom, and at least two of $X^{11}$ to $X^{18}$ are sulfur atoms, wherein the dispersant-type viscosity index improver has a nitrogen atom content in a range of 0.77% to 1.05% by mass, based on a solid content of the dispersant-type viscosity index improver, a content of the dispersant-type viscosity index improver in terms of the solid content is in a range of 0.11% to 0.32% by mass, based on the total amount of the lubricating oil composition, a content of the non-dispersant-type viscosity index improver in terms of the solid content is in a range of from 1.4% to 2.1% by mass, based on the total amount of the lubricating oil composition, a content of the molybdenum-based friction modifier in terms of the solid content is in a range of from 0.10% to 0.70% by mass, based on the total amount of the lubricating oil composition, and a solid content mass ratio of the non-dispersant-type viscosity index improver to the dispersant-type viscosity index improver is in a range of from 4.4 to 12.7.

2. The lubricating oil composition of claim 1, wherein the lubricating oil composition has a kinematic viscosity at 100° C. in a range of from 3.0 to 16.0 $mm^2/s$.

3. The lubricating oil composition of claim 1, wherein the lubricating oil composition has a viscosity index of 150 or more.

4. The lubricating oil composition of claim 1, wherein the dispersant-type viscosity index improver has a molecular weight distribution, Mw/Mn, of 3.0 or less.

5. The lubricating oil composition of claim 1, wherein the molybdenum-based friction modifier is present in a range of from 50 to 2,000 ppm by mass in terms of molybdenum atoms, based on the total amount of the lubricating oil composition.

6. The lubricating oil composition of claim 1, further comprising:

zinc dithiophosphate.

7. The lubricating oil composition of claim 6, wherein the zinc dithiophosphate is in a range of from 200 to 5,000 ppm by mass in terms of phosphorus atoms, based on the total amount of the lubricating oil composition.

8. The lubricating oil composition of claim 1, wherein the lubricating oil composition has a dispersant-derived nitrogen atom content of 0.10% by mass or less, based on the total amount of the lubricating oil composition.

9. The lubricating oil composition of claim 8, wherein the dispersant-derived nitrogen atom content is a total amount of the nitrogen atom derived from a non-boron-modified succinimide and a boron-modified succinimide.

10. The lubricating oil composition of claim 1, wherein the base oil is present in a range of from 70 to 95% by mass, based on the total amount of the lubricating oil composition.

11. A method for producing the lubricating oil composition of claim 1, comprising:

mixing the base oil, the dispersant-type viscosity index improver, the non-dispersant-type viscosity index improver, and the molybdenum-based friction modifier.

12. A diesel engine, comprising:

the lubricating oil composition of claim 1.

13. A method for lubricating an engine, comprising:

contacting the engine with the lubricating oil composition of claim 1.

14. The lubricating oil composition of claim 1, wherein the molybdenum-based friction modifier includes the compound of the formula (D-2), where $R^{11}$ to $R^{14}$ each independently are selected from the group consisting of an isooctyl group and an isotridecyl group, a molar ratio of the isooctyl group to the isotridecyl group in the molybdenum-based friction modifier is 50/50, $X^{13}$ and $X^{14}$ are sulfur atoms, and $X^{11}$ and $X^{12}$ are oxygen atoms.

15. The lubricating oil composition of claim 1, wherein the base oil is present in a range of from 80% to 93% by mass, based on the total amount of the lubricating oil composition.

16. The lubricating oil composition of claim 1, wherein the base oil is present in a range of from 82.93 to 87.63% by mass, based on the total amount of the lubricating oil composition.

17. The lubricating oil composition of claim 1, wherein the base oil includes at least one selected from the group consisting of a mineral oil and a synthetic oil.

18. The lubricating oil composition of claim 1, wherein the base oil includes a Group III mineral oil in American Petroleum Institute base oil category.

19. The lubricating oil composition of claim 1, wherein the lubricating oil composition has a kinematic viscosity at 100° C. in a range of from 7.0 to 10.8 $mm^2/s$.

20. The lubricating oil composition of claim 1, wherein the lubricating oil composition has a viscosity index in a range of 192 to 230.

* * * * *